United States Patent [19]

Beale

[11] Patent Number: 4,458,495

[45] Date of Patent: Jul. 10, 1984

[54] PRESSURE MODULATION SYSTEM FOR LOAD MATCHING AND STROKE LIMITATION OF STIRLING CYCLE APPARATUS

[75] Inventor: William T. Beale, Athens, Ohio

[73] Assignee: Sunpower, Inc., Athens, Ohio

[21] Appl. No.: 349,615

[22] Filed: Dec. 16, 1981

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,824,430 | 2/1958 | Rinia et al. | 62/6 |
| 3,319,416 | 5/1967 | Renshaw | 62/6 |
| 3,858,802 | 1/1975 | Stobart | 62/6 |

*Primary Examiner*—Ronald C. Capossela

*Attorney, Agent, or Firm*—Frank H. Foster

[57] ABSTRACT

A Stirling heat pump driven by a Stirling engine has its stroke limited under conditions of decreasing pump load. This stroke limitation is accomplished by effecting the flow of gas from the engine to the heat pump in response to a maximum piston stroke. Preferably, a valved passageway is formed in communication between the gas in the engine and the gas of the pump. The passageway is valved by a means which normally blocks the flow of gas but opens when the piston of either the pump or the engines strokes to an extreme selected position. The passageway opens into the engine and into the pump at zones so that when the valve is open the zones are at a pressure differential which will cause a flow of gas from the engine to the pump. By this means the power delivered by the heat engine portion of the machine can be made to be equal to the power absorbed by the heat pump at all conditions of heat pump temperature differential.

32 Claims, 12 Drawing Figures

P = HEAT ENGINE PRESSURE

T = EXTERIOR TEMPERTURE FROM WHICH HEAT IS PUMP

P = HEAT PUMP PRESSURE

TK = CONSTANT ENGINE HEATER TEMPERTURE

PRESSURE MODULATION SYSTEM FOR LOAD MATCHING AND STROKE LIMITATION OF STIRLING CYCLE APPARATUS

TECHNICAL FIELD

This invention relates to the prevention of piston overstroking in Stirling cycle machines and more particularly relates to improvements in an apparatus comprising a Stirling cycle engine linked to a Stirling cycle heat pump. The system prevents overstroking of a Stirling engine when the loading decreases beyond selected limits by reducing the engine power output and, when the engine drives a Stirling heat pump, matches the power output of the engine to the power absorbed by the heat pump under all operating conditions of temperature.

BACKGROUND OF THE INVENTION

The increased desirability of energy from solar energy collectors and concentrators and from the burning of inexpensive waste products, has increased the attractiveness of the free piston Stirling engine as a machine for directly converting heat energy to mechanical energy. Additionally, Stirling cycle heat pumps are effective machines for pumping heat from a cold mass to a warm mass. Such heat pumps are useful in refrigeration systems and heating systems. A free piston Stirling cycle engine linked to drive a Stirling cycle heat pump is an efficient, durable apparatus having a long life with low maintenance.

Although such a system can be designed to operate efficiently under a selected set of conditions including a selected load, problems are encountered when such an apparatus has a relatively fixed heat engine power but the load or power demand of the heat pump varies. For example, such a Stirling cycle apparatus, if used for heating the interior of a building, may have a relatively constant energy input but loading variation over a broad range. Such load variation may result from changes in the temperature of the exterior air or other mass from which the heat is pumped.

For example, if such an apparatus operates efficiently on a cold winter day and then the weather changes and becomes warmer, the heat pump is not required to do as much work. Less work is needed to heat the gas in the hot space of the heat pump to the desired temperature.

Because a Stirling engine with a constant input temperature has a tendency to continue delivering power at the same rate per unit of stroke it will begin to overstroke as the power demand of the heat pump becomes less. This can result in damage to the Stirling engine. For example, its overstroking may result in the power piston striking the interior walls at the end of the piston cylinder.

It is therefore an object of the present invention to provide an improvement which automatically prevents this overstroking by more closely matching the power output from the Stirling engine to the power loading demands of the Stirling heat pump as the heat pump temperatures vary.

BRIEF DISCLOSURE OF THE INVENTION

With the present invention the power output of the engine is more nearly matched to the load of the pump by causing working gas to flow from the engine to the heat pump whenever a piston of the engine approaches an excessive stroke. This increases the pressure and mass of working gas in the heat pump and reduces the pressure and mass of working gas in the heat engine, bringing the power generated by the heat engine down and bringing the power absorbed by the heat pump up.

In this manner, when a reduction of power is necessary because the temperature differential of the heat pump decreases, the engine power output and heat pump power absorption are maintained in equilibrium at a safe engine stroke by increasing the pressure of the heat pump thereby increasing its power demand and decreasing the power output of the engine by decreasing its gas pressure.

If the engine has a large gas volume (relatively infinite) relative to the pump gas volume, the power level of the equilibrium state will not change as much as it would if the engine volume were small. However, if the engine working gas volume is small a significant reduction of engine working gas will occur to significantly reduce the power level of the resulting equilibrium.

This is usually desirable for heat pumps used for building heating or cooling because the work demand is reduced as the exterior temperature approaches the interior temperature. However, for more nearly constant power input applications, the engine gas volume can be made large.

One valve mechanism which is advantageous for use in embodiments of the present invention is a slide valve formed by a piston, its cylinder wall and bores through both. The bores are positioned to register and therefore permit gas flow at a selected maximum piston stroke position. In other piston positions, the piston and cylinder walls block flow through the bores.

This slide valve may also be formed by the inner bore of the piston and a central mating rod on which it reciprocates.

A Stirling engine which drives a non-Stirling load or a Stirling heat pump which is driven by a non-Stirling engine may also be stroke limited by transferring gas between the Stirling device and a reservoir.

The invention also contemplates the use of small bounce zone volumes of multiple Stirling devices which operate out of phase and which have their bounce zones interconnected so that there are only relatively small bounce zone pressure variations even though the bounce zones are all of small volume.

Figure 1:
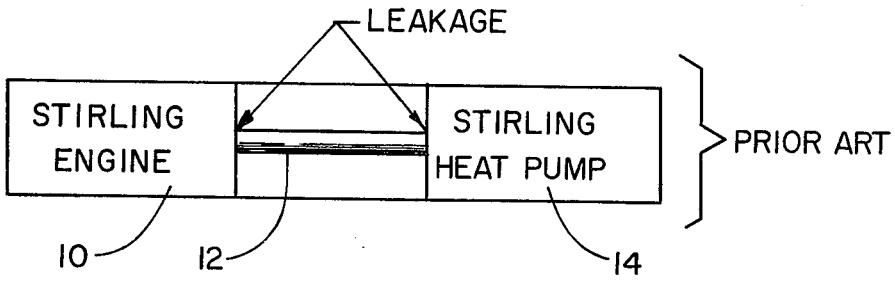
FIG. 1 is a block diagram illustrating a prior art Stirling engine and heat pump connected together.

In describing the preferred embodiments of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose.

DESCRIPTION OF THE PREFERRED EMBODIMENTS

In the embodiments of the invention a valved passageway is provided between the working gas of the engine and the working gas of the pump. The valve is responsive to piston position and opens when the stroke extends to a selected extreme piston position.

In an apparatus having the power piston of the engine linked to the power piston of the pump so that the engine will drive the pump, there is some gas leakage between the engine and the pump. Therefore, ordinarily the average pressure of the two will be identical and during normal operation there will be no net gas transfer from one to the other.

In order to permit gas transfer from the engine to the pump during overstroking, the passageway may open into a zone of the engine which is at a relatively high pressure when the valve is opened. Such a passageway will also open into a pump zone which is at a relatively lower pressure when the valve is opened.

In the preferred embodiment this is accomplished by forming the passageway to communicate between the bounce zones of the two Stirling devices if the devices are directly linked as illustrated in the drawings. Thus, if the valve opens when the bounce zone volume is at its minimum so that the gas in the bounce zone is at its maximum pressure, gas will flow directly from the high pressure bounce zone of the engine to be relatively low pressure bounce zone of the pump.

However, in other embodiments, other zones may be interconnected to effect the flow of working gas from the engine to the pump. For example, in some embodiments of duplex Stirling heat driven heat pumps, the compression zones are preferably connected by the valved passageway. In embodiments with relatively large bounce zones with relatively little pressure variation, zones other than bounce zones may be used.

In addition, the gas flow may be effected by collecting gas at a high pressure in a reservoir which is connected to a zone of time changing engine pressure through a check valve. This reservoir of high pressure gas, which will eventually reach engine maximum cycle pressure, is then valved into a heat pump zone by a valve which is responsive to the maximum stroke of a selected piston.

As another alternative, gas flow from the engine can be effected by pumping it into the heat pump. It can be pumped directly into the heat pump only during an interval of maximum piston stroke or alternatively it could continuously be pumped into a reservoir and then valved into the heat pump in response to a maximum piston stroke. The pump can be formed as a part of the Stirling cycle machines or it can be a separate or external pump.

In the embodiments, normal center leakage, or a specially provided leakage path of suitably high flow resistance, will restore and maintain pressure equilibrium between the engine and the heat pump when there is no overstroking.

FIG. 1 is a simple diagram illustrating a free piston Stirling engine 10 linked by a piston rod 12 to a Stirling heat pump 14. The piston rod 12 is fixed to the power piston of both the engine and the heat pump. Although the piston rod 12 passes through a seal formed in the wall separating the engine 10 from the heat pump 14, such a seal permits some low rate leakage between the engine and pump. During normal operation, the pressure in the engine and in the pump will vary approximately sinusoidally but the average pressure of both will stay approximately the same because of this bidirectional leakage.

Figure 2:
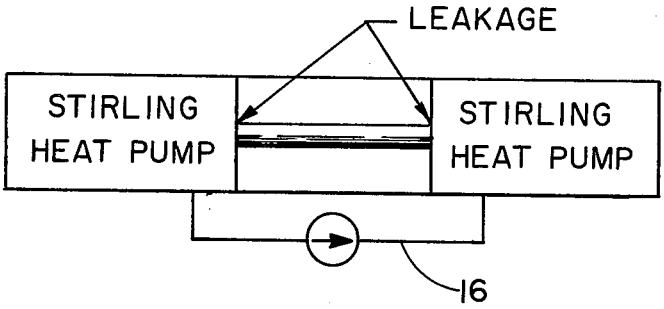
FIG. 2 is a block diagram illustrating the operation of the preferred embodiment of the invention.

FIG. 2 illustrates a gas passageway, in addition to the leakage path, provided between the engine and the pump. This passageway 16 is formed so that it will allow gas flow in only one direction. If it is constructed in accordance with the preferred embodiment no check valve is needed. The flow rate through the passageway 16 will be considerably higher than the leakage flow rate whenever the engine approaches the overstroking condition so that there will be a net gas transfer to the heat pump. This transfer of gas decreases the power delivered by the engine and decreases or limits its stroke. The heat pump can then transfer the required quantity of heat without increased stroke. This gas transfer also results in an increase in the average pressure of the heat pump above the average pressure of the Stirling engine which increases the power absorbed by the heat pump.

The difference in the average pressures means a continuous leakage will occur back toward the Stirling engine tending to make the pressures equalize.

In the preferred embodiment, an equilibrium condition will be reached for any loading of the heat pump. For example, as outdoor temperature rises and the engine begins to overstroke, gas will be delivered to the heat pump. The delivery of gas will reduce the overstroke of the engine will just enough stroke occurs that a quantity of gas will be delivered equal to the gas which leaks across back to the Stirling engine and the engine will operate at this equilibrium condition.

The transfer of gas out of the heat engine upon the overstroking condition reduces engine power output by an additional phenomenon. The removal of gas from the heat engine reduces the engine pressure and therefore reduces the pressure of the gas spring which operates upon the displacer.

Operation frequency is determined principally by the operating conditions of the heat pump. Therefore, this loss of gas from the engine will not significantly alter the operating frequency. However, the reduced pressure of the gas spring will cause a phase change to occur in the engine which will reduce the engine power output. More particularly, the phase lead of the displacer ahead of the piston, which may normally be nominally 90°, will be decreased to a smaller phase lead of, for example, 60°. This phase variation also has the effect of decreasing engine power output.

Figure 3:
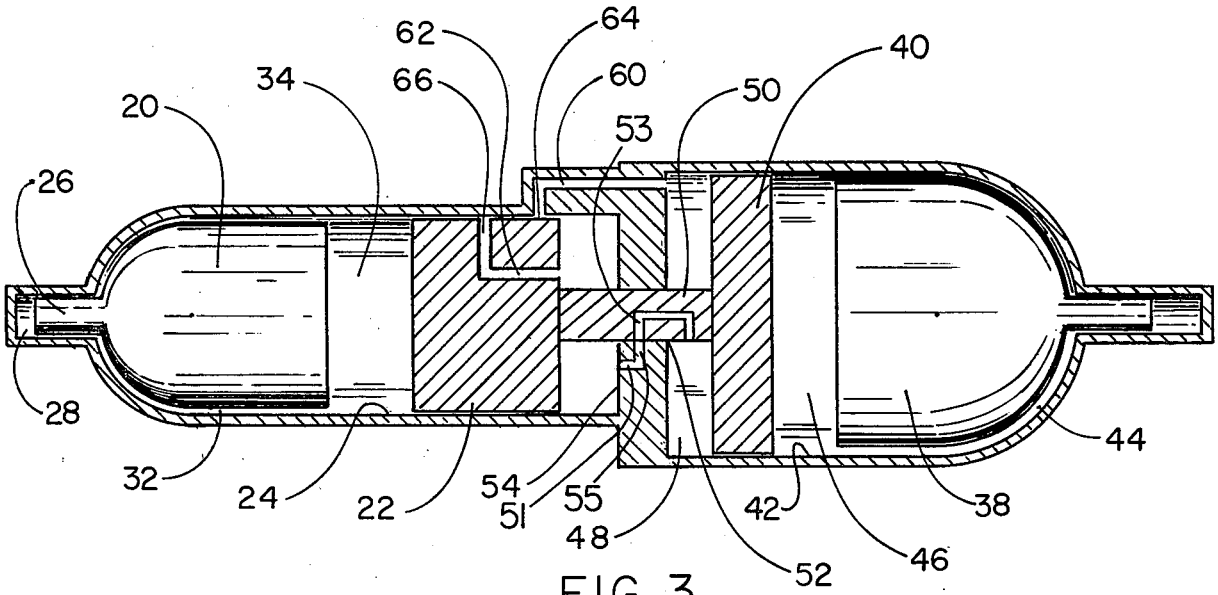
FIGS. 3 and 4 are diagrammatic views in axial section illustrating the preferred embodiment of the invention.
Figure 4:
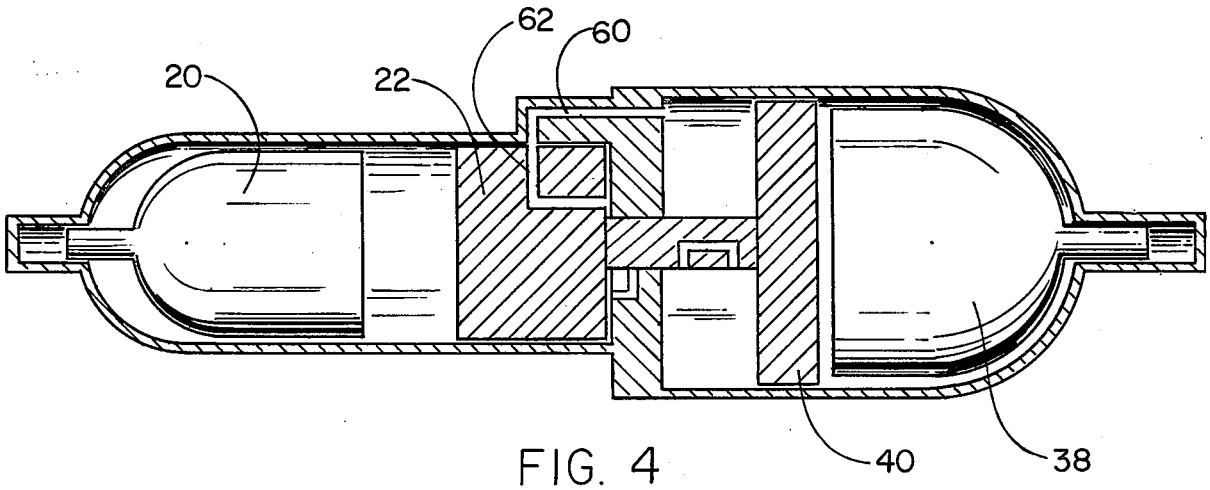

FIGS. 3 and 4 diagrammatically illustrate in more detail the preferred embodiment of the invention. These drawings are diagrammatic in that conventional structures such as the regenerators, cooling jackets and many of the other conventional details of construction have been eliminated to more clearly illustrate the principles of the present invention.

The heat pumping apparatus of FIGS. 3 and 4 has a free piston Stirling engine including a displacer piston 20 and power piston 22 mounted for reciprocation in a cylinder 24. The displacer piston 20 is fixed to a piston rod 26 which cooperates with a gas spring 28 so that variations of working gas pressure in the work space 30 will cause the appropriate oscillating motion of the displacer 20 in the conventional manner. The work space has a hot zone 32 and a cold zone 34. A bounce zone 36 is formed adjacent to the power piston 22.

In a similar manner the heat pump has a displacer piston 38 and a power piston 40 which is mounted in a cylinder 42 which defines a hot zone 44, a cold zone 46 and a bounce zone 48.

The power pistons 22 and 40 are connected by a connecting rod 50 which slides through a seal 52 formed in the wall 54 separating the engine bounce zone 36 from the pump bounce zone 48. In order to insure that the pressure averaging takes place a center port arrangement forming a leakage path is made in the seal such that at the mid point of the piston stroke a small passageway 51 is opened, such as by a port 53 on the rod coming into registration with a port 55 in the seal. For a brief time both bounce spaces are in direct communication and an equalizing flow can occur, but because of the small diameter of passageway 51 the flow is not so great that it cannot be easily counteracted by the power matching flow.

A load matching passageway is formed in communication between the working gas of the engine and the working gas of the pump. The passageway includes the conduit 60 extending from the bounce space 48 of the pump through a port 64 formed in the cylinder wall 24 of the engine. The passageway also includes a pair of intersecting bores forming a gas conducting path 62 through the power piston 22.

In the preferred embodiment, the position of the power piston 22 of the engine is used to detect an overstroke condition. The passageway is formed to open into the engine at a zone which is under a high pressure when the power piston reaches the limits of the desired stroke.

The passageway is opened and closed in accordance with the position of the power piston 22. As can be seen in FIG. 3, the passageway is blocked except when the port 64 is in registration with the port 66 in the exterior wall of the power piston 22. These ports are positioned so that they will be in registration when the power piston reaches the desired limits of its stroke as illustrated in FIG. 4.

In designing an apparatus embodying the present invention, it is preferred that the engine and pump be designed so that under the maximum anticipated load conditions, for example the coldest expected exterior temperature, the apparatus will operate efficiently with equal average pressures.

As the exterior temperature rises the engine power piston stroke will increase as the pump absorbs less power. However, if the temperature rises sufficiently, the piston stroke becomes excessive and the ports come into registration. The transfer of gas then occurs as described above to limit the stroke of the engine power piston by decreasing engine power output and increasing heat pump power absorbed.

When the passageway is opened, the bounce zone 36 of the engine is at its maximum pressure and the bounce zone 48 of the pump is at a minimum pressure. Thus, when the passageway opens during the maximum pressure differential, the rate of gas transfer while the passage is open is maximized.

If the temperature of the mass from which the heat is pumped subsequently falls so that the power absorbed by the heat pump increases, the temperature change will occur at a sufficiently slow rate under ordinary weather conditions that the seal leakage described above and the center portive system permits the eventual equalization of the average pressure in both the engine and the pump.

This operation is illustrated in FIG. 6. The present invention matches the power output from a heat engine having a constant temperature input to the power absorbed by a heat pump which is pumping heat from a mass having a variable temperature.

Figure 6A:
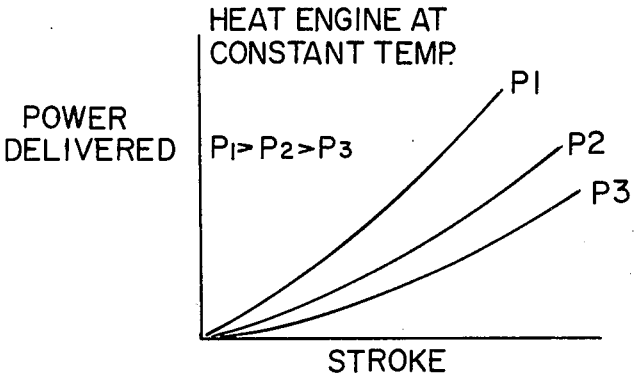
FIG. 6 shows three graphs illustrating the operation of embodiments of the invention.

FIG. 6*a* illustrates the operation of the heat engine at a constant temperature $T_k$ for different average working gas pressures $P_1$, $P_2$, and $P_3$. It illustrates that a Stirling heat engine having a constant input temperature will operate along a characteristic curve relating the power it delivers to its piston stroke. A family of characteristic curves exist for different pressures at which the engine operates. FIG. 6*a* illustrates that as working gas average pressure is reduced the characteristic curve is lowered. This means that if the stroke remains constant but the pressure of the engine is reduced the power delivered by the heat engine will similarly be reduced.

Figure 6B:
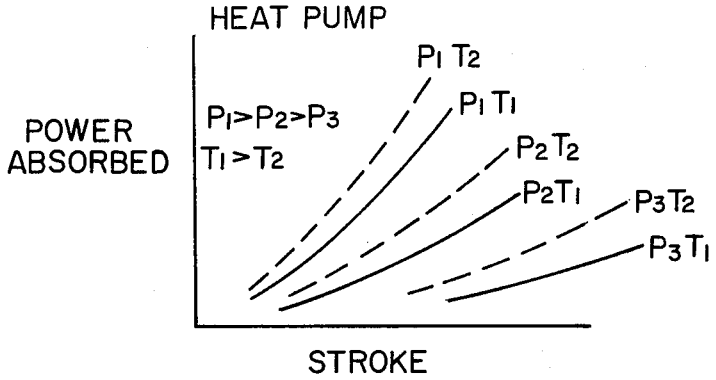

FIG. 6*b* illustrates with a solid line graph a family of curves corresponding to the curves of 6*a*, but for the heat pump. The characteristic curves of FIG. 6*b* illustrate curves for the heat pump which are the same as illustrated by the solid line graphs of FIG. 6*a*. They are a family of constant temperature curves for varying pressure. However, FIG. 6*b* additionally has dashed graphical curves which illustrate the effect of temperature changes upon the relationship between the power absorbed by the heat pump and the stroke of the heat pump. FIG. 6*b* illustrates that decreases in the temperature of the mass from which heat is pumped result in a raising of the characteristic curves. This indicates that if the temperature of the exterior air is increased and the stroke remains constant, then the power absorbed by the heat pump will be decreased. It also illustrates that if the power absorbed by the heat pump remains constant, the heat pump stroke will increase eventually leading to the engine damage being prevented by the present invention.

Figure 6C:
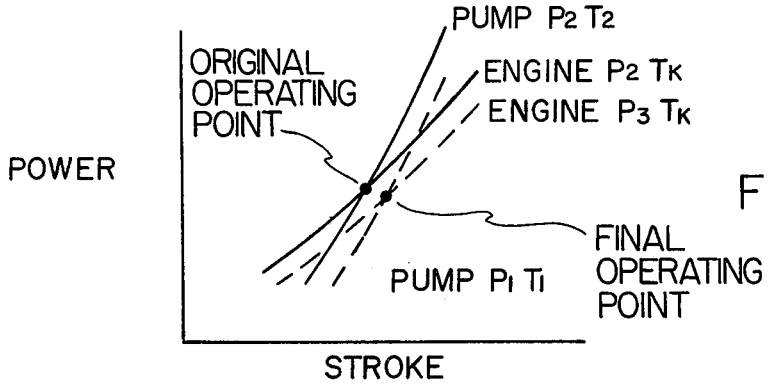

FIG. 6*c* illustrates how the present invention matches the power delivered by the heat engine to the power absorbed by the heat pump in accordance with the present invention. FIG. 6*c* shows a pair of solid line curves, one illustrating a characteristic curve for the heat pump at pressure $P_2$ and temperature $T_2$ and the other indicating the characteristic curve for the heat engine at pressure $P_2$ and temperature $T_k$, the constant engine input temperature. This represents the operating condition of relatively low exterior temperature for which the engine is designed to operate most efficiently with the pump pressure and engine pressure being identical. The intersection of these two curves is the operating point at which the two will have essentially the identical stroke and the power delivered by the heat engine will equal power absorbed by the heat pump.

From FIGS. 6*a* and 6*b* it can be seen that a rise in the temperature of the exterior mass from which heat is pumped results in the characteristic curve for the pump moving downwardly and to the right.

If no change is made to vary the position of the engine characteristic curve, the intersection of these two curves will be moved toward a greatly increased stroke.

However, if the heat engine pressure is decreased from $P_2$ to $P_3$ the characteristic curve for the heat engine will move to the dashed line position illustrated in FIG. 6c.

Additionally, the transfer of gas from the heat engine to the heat pump not only reduces the power delivered by the heat engine but additionally increases the power absorbed by the heat pump. Consequently, the movement of the characteristic curve for the heat pump is minimized because increasing the average pressure of the heat pump tends to raise the heat pump characteristic curve thereby aiding in the offset of the downward shift of the heat pump characteristic curve caused by increasing the exterior temperature.

Therefore, when the exterior temperature increases both characteristic curves will shift and an intersection will still occur at a stroke which is increased by only a safe amount.

As the exterior temperature changes, the movement of the heat pump operating line may be minimized if the heat engine is kept at nearly constant pressure by use of a large bounce zone volume or other reservoir, so that as heat pump pressure rises, heat engine pressure diminishes only slightly.

Figure 5:
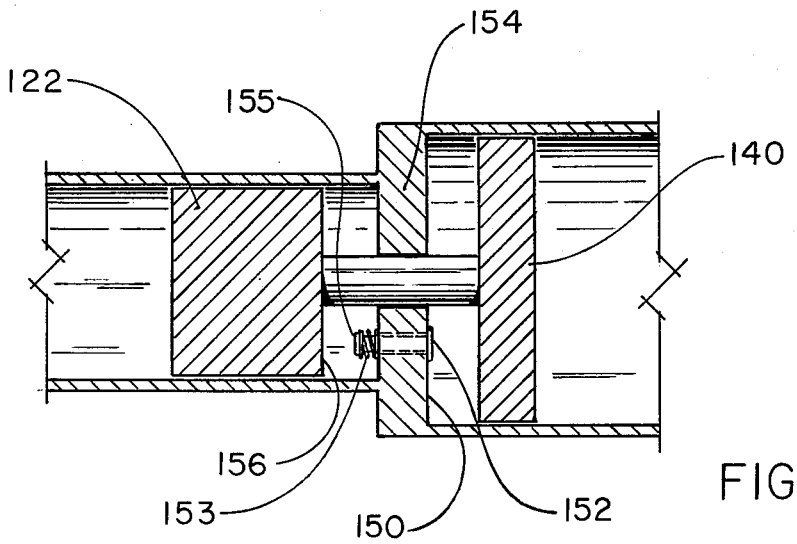
FIG. 5 is a segmental view illustrating an alternative embodiment of the embodiment.

There are many alternative embodiments of the invention and FIG. 5 illustrates one alternative means for forming the passageway and valve.

FIG. 5 shows an engine power piston 122 and pump power piston 140 having bounce zones separated by a wall 154, all as illustrated in FIGS. 3 and 4.

However, the gas conducting passageway is a bore 150 through the wall 154. The bore 150 contains a valve 152 which is biased by a spring 154 to its closed position. The valve includes an arm 155 which extends into the path of the engine power piston 122. Whenever the piston 122 moves sufficiently into the bounce zone, the end 156 of the power piston 122 will strike the arm 155 of the valve 152 and open it under the proper phase conditions. This will permit the passage of gas during the high pressure portion of the bounce zone pressure cycle of the engine and the low pressure portion of the pressure cycle of the pump bounce zone.

It should also be understood that the principles of the present invention may be applied to Stirling systems in which the engine and pump are coupled by means other than a mechanical connection such as the piston rod 50. For example the pistons may be coupled by a relatively stiff spring such as a gas spring.

Figure 7:
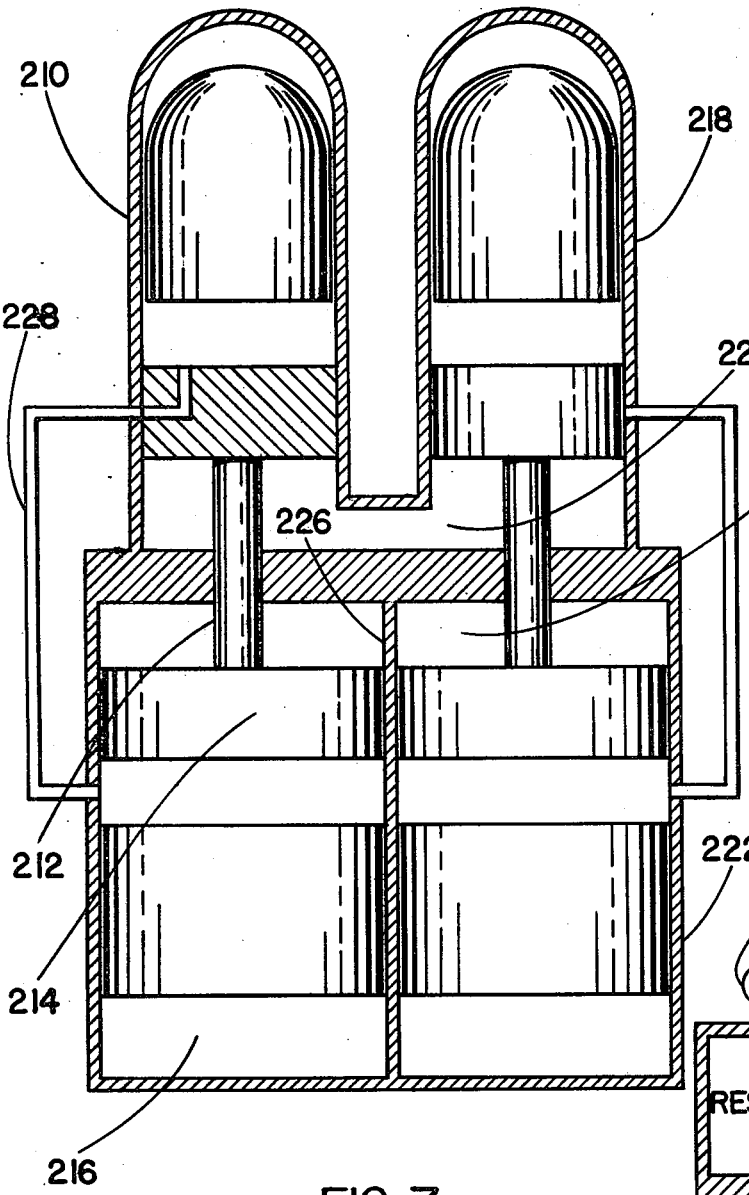
FIG. 7 is a diagrammatic view of a twin duplex embodiment of the invention.

FIG. 7 illustrates a twin duplex opposed motion Stirling cycle apparatus. Opposed motion has the advantage of lower vibrations because it leaves only an unbalanced couple. The apparatus has a first Stirling engine 210 coupled through a piston rod 212 to the power piston 214 of a Stirling heat pump 216. Similarly it has a second Stirling engine 218 also coupled through a piston rod 220 to a Stirling heat pump 222. The bounce spaces of the two engines 210 and 218 are interconnected through the opening 224 and the bounce spaces of the heat pumps 216 and 222 are interconnected through an opening 226. The two engine/heat pump pairs are operated 180 degrees out of phase and therefore the total volume of the bounce spaces of the engines and similarly of the bounce spaces of the heat pumps do not change during operation. Consequently the bounce space gas pressures do not vary.

In the embodiment of FIG. 7 gas flow between the engine and heat pump of each pair is effected through a passageway such as passageway 228 from the compression space of the engine to the compression space of the heat pump. The engine and heat pump are phased so that a slide valve mechanism formed in the piston and cylinder wall, such as described above, is opened to permit the flow of gas when the power piston of the engine is at a selected maximum excursion in the direction which minimizes working space volume; that is when the power piston is in the position where working space pressure is relatively high in the heat engine and relatively low in the heat pump.

Figure 8:
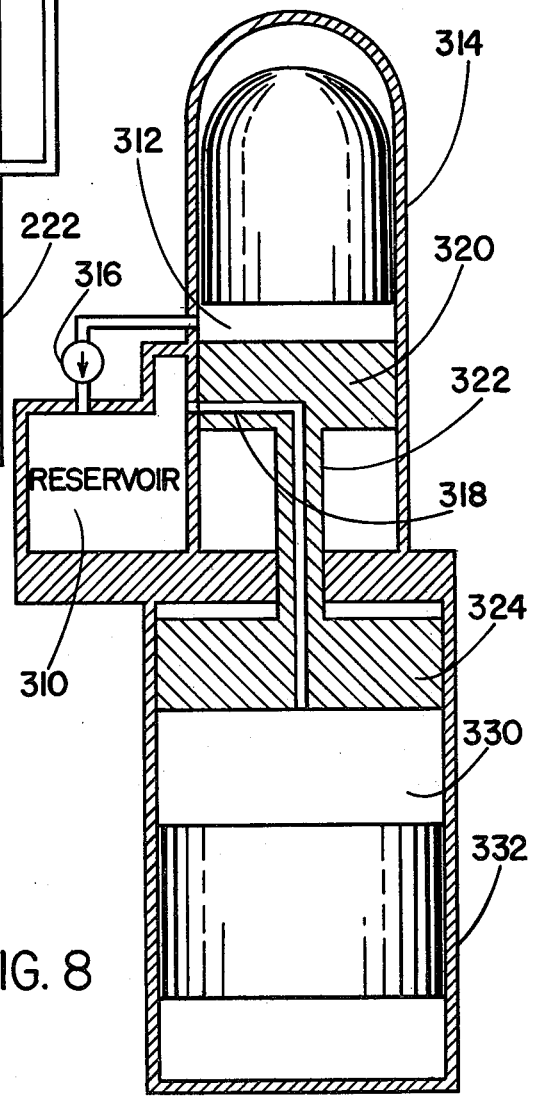
FIG. 8 is a diagrammatic view of an embodiment utilizying a reservoir, check valve and slide valve system embodying the invention.

FIG. 8 illustrates an embodiment in which a reservoir 310 is connected to receive gas flow from the work space 312 of the Stirling engine 314 during the high pressure interval of each cycle. Reverse flow of gas is prevented by the check valve 316. A sliding valve is formed as in the other embodiments through power piston 320, connecting rod 322 and power piston 324.

The passageway 318 is formed by bores in the cylinder wall and power piston 320 which come into registration and open the valve when the power piston 320 is at a selected maximum stroke position which creates a minimum working gas volume. In other positions the valve is blocked.

In this embodiment of FIG. 8 the reservoir 310 will reach a gas pressure equal to the peak gas pressure of the gas in the work space 312. Whenever the piston 320 reaches the maximum selected stroke position the high pressure gas from the reservoir 310 will flow through the passageway 318 into the work space 330 of the heat pump 332 which will be at the low pressure portion of its cycle.

Figure 9:
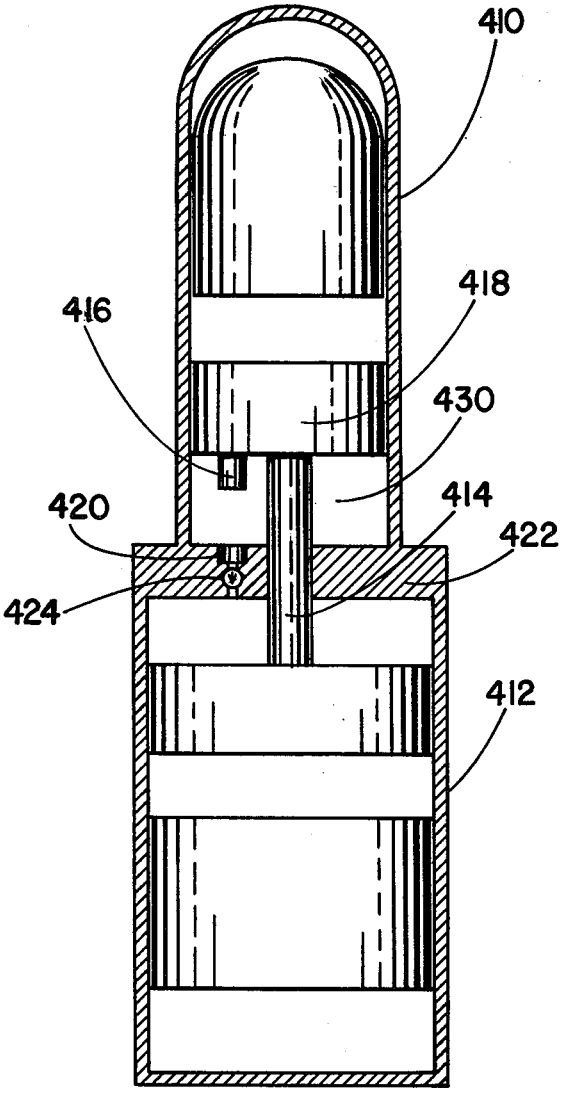
FIG. 9 is a diagrammatic view of an embodiment of the invention utilizying a pump and check valve for effecting the flow of gas from the engine to the heat pump.

FIG. 9 illustrates an embodiment of the invention having a pumping means connected in the passageway for effecting the transfer of gas under overstroking conditions.

It has a heat engine 410 connected to a heat pump 412 through a piston rod 414 in a manner similar to the other embodiments. However, a small piston 416 is formed by a rod which protrudes downwardly from the power piston 418. It cooperates during overstroking conditions with a mating cylinder 420 formed in the block 422. The cylinder 420 is connected through a passageway having a pressure responsive check valve 424.

If the bounce spaces are relatively large so that pressure variations are minimum then an ordinary check valve may be used, however, if the bounce spaces are small so that each undergoes significant pressure variations during each cycle, the check valve must open only in response to a sufficient pressure.

If the power piston 418 exceeds the maximum stroke, the small piston 416 will enter the cylinder 420 creating a miniature pump which will effect the flow of gas from the engine 410 to the heat pump 412. When a suitably small bounce space and pressure responsive check valve, the power piston itself can perform the function of the small piston 416 so that the small piston 416 can be eliminated. In such an embodiment overstroking would be detected and the pressure responsive check valve 424 actuated by the increase of bounce space pressure in the bounce space 430 above a selected limit. In such an embodiment, the end wall of power piston 418 and the power piston 418 itself function as the gas pumping means.

Alternatively, other gas pumping means may be used. For example, a pump can be connected externally to the engine or other pumps can be used which tend to pump gas from the engine to the heat pump. Such pumps are actuated by overstroking conditions or are operated in cooperation with a valve such as those described above which is opened to permit the flow upon the maximum stroke position of the piston.

It should be noted that, for the sake of simplicity in the diagrammatic drawings, a gas spring volume, such as 28 in FIG. 3, or an equivalent space which exerts a force on the displacer is not shown. As well known in the art, the displacer of a free piston Stirling device must always operate in cooperation with such a space so that variations in working space pressure will cause reciprocating movement of the displacer. This gas spring space, as is well known in the art, may be the bounce zone, it may be formed in the power piston, in the displacer or in the end of the cylinder housing opposite to the power piston. Since all these variations are known in the art they are not always illustrated.

Figure 10:
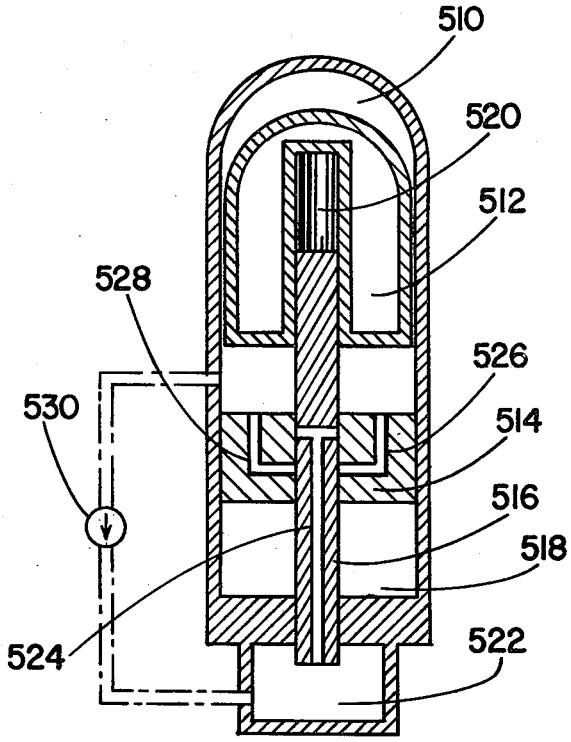
FIG. 10 is a diagrammatic view of an embodiment of the invention in which the stroke of the power piston is limited by using a reservoir as is appropriate when only one Stirling device is used.

FIG. 10 schematically illustrates a Stirling device which could be either a Stirling engine or heat pump. No linkage to its power piston is illustrated for applying or withdrawing power to it because many such linking structures for using mechanical output power from a Stirling engine or applying mechanical power input to a Stirling heat pump are well known.

The device of FIG. 10 has a work space 510 in which a displacer 512 reciprocates. A power piston 514 and the displacer 512 are provided with central bores and both reciprocate on a coaxial, central mating rod 516 which extends through the bounce space 518. The gas spring 520 is formed in the displacer 512. The reservoir 522 is formed in communication with a passageway 524 bored in the central rod 516. Passageways 526 and 528 are formed in the power piston.

The central rod 516, the power piston 514 and the passageways formed in them form a spool valve which is quite similar to those described above. If the power piston makes its maximum stroke or excursion on the compression stroke so that the passageways come into registration, gas in the working space 510 may flow through the passageways into the reservoir 522. Gas will flow in that direction because the registration of the passageways will occur when the working space is at a maximum pressure and minimum volume. Such a flow of gas will reduce the quantity of gas in the working space and thereby will reduce the power output if the device is operated as an engine.

During the remainder of each stroke whenever the gas pressure of the reservoir 522 is greater than the pressure in the zones of the Stirling device, a slow controlled and restricted flow of gas out of the reservoir back into the device zones will occur between the interfacing bearing surfaces between the power piston 514 and the central rod 516. Thus, if the reservoir 522 is sufficiently large, gas will continue to flow into the reservoir until an equilibrium is reached in which just enough gas will flow in the reservoir each stroke to replace that which leaks back into the engine during the remainder of each stroke.

If the operating conditions change such that the stroke is reduced then the reservoir will continue to leak gas back into the zones of the Stirling device until equilibrium is again reached at which the reservoir pressure will return to the average pressure of the Stirling device.

If the device of FIG. 10 operates as a heat pump, then a check valve 530 will be provided so that the reservoir will pressurize to the maximum pressure of the engine during normal operation. The reservoir is then used to increase the power absorbed by the heat pump by increasing the working gas in the heat pump upon an overstroking condition to thereby reduce or limit the engine stroke. Although slow controlled restricted leakage will continue to result through the bearings as described above, it will be replaced through the check valve. If an overstroking condition is reached the passageways come into registration and gas is thereby supplied from the reservoirs 522 into the working zone to thereby increase the power absorbed and limit the stroke. The flow through the passageways is relatively unrestricted so that there will be a net flow of gas from the reservoir into the working space until the overstroke condition ceases.

It is to be understood that while the detailed drawings and specific examples given describe preferred embodiments of the invention, they are for the purposes of illustration only, that the apparatus of the invention is not limited to the precise details and conditions disclosed and that various changes may be made therein without departing from the spirit of the invention which is defined by the following claims.

I claim:

1. A method for matching the power output from a free piston Stirling cycle engine to the loading power demand by a free piston Stirling cycle heat pump which is drivingly connected to said engine in order to limit the stroke of the connected free piston Stirling cycle devices, the method comprising effecting the flow of gas from said engine to said heat pump so that the power absorbed by the heat pump is increased.

2. A method in accordance with claim 1 wherein said gas flow is effected by connecting in communication during a maximum stroke interval of a cycle, a zone of said engine which is at a relatively higher pressure during said interval to a zone of said pump which is at a relatively lower pressure during said interval.

3. A method in accordance with claim 1 wherein said gas flow is effected by pumping gas from said engine to said pump during a maximum stroke interval of a cycle.

4. A method in accordance with claim 1 wherein said gas flow is effected by admitting gas from said engine into a reservoir during a relatively higher pressure interval of a zone of said engine and admitting gas from said reservoir into said pump during a maximum stroke interval of a cycle.

5. In a heat driven heat pumping apparatus including at least a pair of Stirling cycle machines one of said machines comprising a Stirling engine of the free piston type including a displacer piston and a power piston each mounted for reciprocation in its associated cylinder said engine being drivingly linked to the second Stirling cycle machine comprising a Stirling heat pump of the free piston type including a displacer piston and a power piston each mounted for reciprocation in its associated cylinder, said engine and said pump each having a hot zone and a cold zone which together define a working gas zone and a bounce zone; a load matching, stroke adjusting improvement comprising:

(a) a passageway in communication between a zone of said engine and a zone of said pump; and (b) a valve means in said passageway normally blocking the flow of gas through said passageway and responsive to the position of a selected one of said pistons for opening said passageway in response to a selected maximum position of said selected piston to permit gas flow from said engine to said pump.

6. An apparatus in accordance with claim 5 wherein said passageway extends between the bounce zone of each of said Stirling cycle machines.

7. An apparatus in accordance with claim 5 wherein said valve means comprises a slide valve formed by (i) said selected piston; (ii) its cooperating cylinder wall; and (iii) bores formed in said cylinder wall and said selected piston as a part of said passageway and wherein said bores are positioned to come into registration at said maximum position of said piston.

8. An apparatus in accordance with claim 5 wherein said valve means comprises a valve actuated by an arm which extends into the path of said selected piston.

9. An apparatus in accordance with claim 5 wherein a reservoir is formed in said passageway intermediate said valve means and said pump zone and a check valve is connected in said passageway intermediate said reservoir and said engine zone polarized to permit gas flow to said reservoir.

10. An apparatus in accordance with claim 9 wherein said valve means comprises a slide valve formed by (i) said selected piston; (ii) its cooperating cylinder wall; and (iii) bores formed in said cylinder wall and said selected piston as a part of said passageway and wherein said bores are positioned to come into registration at said maximum position of said piston.

11. An apparatus in accordance with claim 5 wherein said passageway extends between the working gas zones of each of said Stirling cycle machines.

12. An apparatus in accordance with claim 5 wherein said passageway extends between the cold zones of each of said Stirling cycle machines.

13. An apparatus in accordance with claim 12 wherein said valve means comprises a slide valve formed by (i) said selected piston; (ii) its cooperating cylinder wall; and (iii) bores formed in said cylinder wall and said selected piston as a part of said passageway and wherein said bores are positioned to come into registration at said maximum position of said piston.

14. An apparatus in accordance with claim 5 wherein said apparatus comprises a plurality of pairs of the Stirling cycle machines defined in claim 5, the bounce zones of the engines being connected in communication and the bounce zones of the pumps being connected in communication.

15. An apparatus in accordance with claim 14 wherein each of the two passageways extend between the working gas spaces of each pair of Stirling cycle machines.

16. In a heat driven heat pumping apparatus including a pair of Stirling cycle machines one of said machines comprising a Stirling engine of the free piston type including a displacer piston and a power piston each mounted for reciprocation in its associated cylinder said engine being drivingly linked to the second Stirling cycle machine comprising a Stirling heat pump of the free piston type including a displacer piston and a power piston each mounted for reciprocation in its associated cylinder, said engine and said pump each having a hot zone, a cold zone and a bounce zone; a load matching, stroke adjusting improvement comprising:

(a) a passageway in communication between the gas of said engine and the gas of said pump, said passageway opening into a zone of a selected one of said Stirling machines, said zone being bounded by an end of one of the pistons of said selected Stirling machines; and (b) passageway valving means normally blocking the flow of gas through said passageway and responsive to the position of said one of said pistons for opening said passageway when said one piston moves into said zone to a selected position.

17. A machine in accordance with claim 16 wherein said passageway extends between said bounce zones and said one of said pistons is the power piston.

18. A machine in accordance with claim 17 wherein said valving means comprises a valve actuated by an arm which extends into the path of one of said power pistons.

19. A machine in accordance with claim 18 wherein said cylinders are substantially coaxial and the Stirling cycle machines are linked by a piston rod which is fixed to each power piston and extends sealingly through a wall separating the bounce spaces and wherein said valve and said passageway are positioned in said wall.

20. A machine in accordance with claim 19 wherein said machines are charged with a mass of gas for operation within selected piston stroke limits at a selected maximum power output with the same average gas pressure and wherein said valve arm is actuated by the power piston of said engine.

21. A machine in accordance with claim 16 wherein a port is formed in the wall of said cylinder and a port is formed in the exterior wall of said one piston, said ports being positioned for registration when said one piston is at said selected position but being blocked at other operating positions of said one piston by the walls of said piston and of said cylinder respectively and wherein said passageway extends through said ports and through said one piston.

22. A machine in accordance with claim 21 wherein said cylinders are substantially coaxial and the Stirling cycle machines are linked by a piston rod which is fixed to each power piston and extends through a wall separating the two bounce zones.

23. In a heat driven heat pumping apparatus including at least a pair of Stirling cycle machines one of said machines comprising a Stirling engine of the free piston type including a displacer piston and a power piston each mounted for reciprocation in its associated cylinder said engine being drivingly linked to the second Stirling cycle machine comprising a Stirling heat pump of the free piston type including a displacer piston and a power piston each mounted for reciprocation in its associated cylinder, said engine and said pump each having a hot zone and a cold zone which together define a working gas space and a bounce zone; a load matching, stroke adjusting improvement comprising:

(a) a passageway in communication between a zone of said engine and a zone of said pump;

(b) a pressure responsive check valve connected in said passageway for permitting gas flow toward said pump in response to a sufficient pressure; and (c) a gas pumping means connected in said passageway and cooperating with a selected one of said pistons, said gas pumping means being actuated by said selected piston when said selected piston is in a selected overstroke position.

24. A free piston Stirling cycle apparatus having a relatively small bounce space volume yet exhibiting relatively small bounce space pressure variations, said apparatus comprising:

(a) a plurality of free piston Stirling cycle devices each having a displacer reciprocating in a work zone, a reciprocating power piston bounding the work zone on one of its ends and a bounce zone bounded by the other end of the power piston, wherein the power pistons reciprocate out of phase with each other at a phase relationship which maintains a substantially constant total volume of said bounce spaces; and (b) a passageway interconnecting the bounce zones of said Stirling devices so that gas may flow between said bounce zones.

25. An apparatus in accordance with claim 24 wherein said plurality of Stirling devices comprises a pair of such devices operating 180° out of phase and having power pistons having substantially equal displacements on each stroke.

26. An apparatus in accordance with claim 24 wherein said Stirling cycle devices are all Stirling motors and wherein each is drivingly linked to a different Stirling cycle heat pump, each of said heat pumps having all the elements as those described in elements (a) and (b) of claim 24.

27. An apparatus in accordance with claim 26 wherein there are two said Stirling cycle motors and two of said Stirling cycle heat pumps operating 180° out of phase, the power pistons of said heat pumps having substantially the same displacement as each other and the power pistons of said motors having substantially the same displacement.

28. A method for matching the power output from a Stirling cycle engine driving a load to the loading power demand of said load, the method comprising effecting the flow of gas out of the engine and into a reservoir in response to a maximum piston stroke and permitting the continuous restricted return flow of gas from the reservoir into the engine.

29. A method for limiting the stroke of a Stirling cycle heat pump driven by a variable stroke engine the method, comprising maintaining a reservoir separate from the working gas of said heat pump at a gas pressure greater than a pressure of the heat pump and effecting a flow of gas from the reservoir into the pump in response to a maximum piston stroke.

30. An improved free piston Stirling cycle apparatus having gas containing zones wherein the improvements comprises:

(a) a reservoir;

(b) a passageway containing a valve means and communicating between said reservoir and a first zone of said apparatus, the valve means normally blocking the flow of gas through said passageway but opening in response to a selected maximum stroke position of a piston of said Stirling cycle apparatus; and (c) a second passageway in communication between said reservoir and said first zone of said Stirling apparatus for permitting the continuous restricted return flow of gas from the reservoir to said first zone of the Stirling apparatus.

31. An apparatus in accordance with claim 30 wherein said Stirling apparatus is an engine and said second passageway is sufficiently restricted so that the pressure of said reservoir and said engine zone will equilize only after several cycles of apparatus operation.

32. An apparatus in accordance with claim 30 wherein said Stirling apparatus is a heat pump and wherein said second passageway contains a second valve means which opens only to admit gas into the reservoir.

* * * * *